United States Patent [19]

Kershaw

[11] Patent Number: 4,691,209

[45] Date of Patent: Sep. 1, 1987

[54] WIDEBAND ANTENNA

[75] Inventor: Joseph E. Kershaw, La Mesa, Calif.

[73] Assignee: The United States of America as represented by the Secretary of the Navy, Washington, D.C.

[21] Appl. No.: 766,462

[22] Filed: Aug. 19, 1985

[51] Int. Cl.[4] ..... H01Q 9/28; H01Q 21/00

[52] U.S. Cl. ..... 343/846; 343/729; 343/850; 343/799

[58] Field of Search ..... 343/725, 729, 790, 791, 343/792, 825, 828, 829, 830, 846, 799, 820, 850

[56] References Cited

U.S. PATENT DOCUMENTS

| | | | |
|---|---|---|---|
| 2,425,585 | 8/1947 | Wheeler | 250/33 |
| 2,513,336 | 7/1950 | Lewis | 250/33 |
| 3,071,771 | 1/1963 | Scheldorf | 343/828 |
| 3,618,107 | 11/1971 | Spanos . | |
| 3,665,478 | 5/1972 | Dempsey . | |
| 3,852,760 | 12/1974 | Reggia . | |
| 4,208,662 | 6/1980 | Horn et al. . | |

*Primary Examiner*—Robert E. Wise
*Assistant Examiner*—D. Johnson
*Attorney, Agent, or Firm*—R. F. Beers; E. F. Johnston; H. Fendelman

[57] ABSTRACT

A wideband antenna with reduced diameter and volume compared to prior art antennas and having non-critical dimensions resulting in ease of manufacture and tolerance to damage in portable applications and during installation. In one embodiment the antenna is comprised of a vertical element, a number of equally spaced, equal length horizontal elements in the form of a disc and a number of equally spaced, equal length round plane elements in the form of a cone. The vertical and horizontal elements are connected to the inner conductor of a coaxial transmission line and the conical elements are connected to the outer conductor transmission line. In a second embodiment of the present invention, the vertical element is deleted and a parallel inductor is connected between the transmission line outer and inner conductors.

10 Claims, 8 Drawing Figures

WIDEBAND ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to the field of antennas and, more particularly, to the field of antennas that radiate in the 30–88 MHz frequency range.

A discone antenna is a vertically polarized, wideband antenna providing omnidirectional coverage in a simple mechanical design. The outer conductor of the transmission line associated with the antenna is connected to the cone radiating portion of the antenna at the gap between the cone and the disc radiating portion and the inner conductor of the transmission line is connected to the center of the disc. The disc and the cone are insulated from each other by suitable means. The feed point impedance of a discone antenna may be close to 50 ohms and result in good VSWR in the design frequency range. Over the frequency range 30–88 MHz, gain, on the horizon (0°), is comparable to a ground plane or a biconical antenna.

Such discone antennas require antenna volumes which are about twice as large for the same low frequency cutoff point as the present invention, are too large for transportable field use at low VHF and high HF frequencies, are much more difficult to install and to remove than the present, require more maintenance effort and are more expensive to purchase than the antennas disclosed herein.

The United States Department of Defence (DoD) utilizes a ground plane antenna known as the RC-292 antenna which operates over a 30–76 MHz range by use of three physical configurations. The RC-292 antenna is illustrated in FIG. 1 and will be described further in the body of the specification herein. Subbands for these three physical configurations are 30–36.5, 36.5–50.5 and 50.5–76 MHz. As designed, the RC-292 is a groundplane antenna and has limited VSWR bandwidth and gain. The operational requirements for this antenna often force the operators to use the midband configuration across the entire 30–76 MHz band and, as a result, efficiency is degraded to as little as 10% when compared to a properly configured RC-292 antenna. Further, it has recently become desirable to extend the frequency range of the RC-292 up to 88 MHz.

SUMMARY OF THE INVENTION

Accordingly, the present invention is directed to an improved discone antenna that achieves a reduction in antenna volume of 50% of the volume required for prior art discone antennas. Consequently, the improved discone antenna of the present invention results in reduced size and weight of the supporting mass structure, improved field installation and take-down times for portable installations, reduced procurement and maintenance costs, and the resulting improved military utility associated with each of the preceeding.

In one embodiment, the improved discone antenna of the present invention is achieved by adding a disc-type radiating structure to the basic RC-292 design, the disc-type radiating structure being comprised of a plurality of equally spaced horizontal radiating elements, preferably six. Further, in this embodiment of the present invention a parallel inductor is connected such that one end is attached to the inner conductor of the coaxial transmission line feeding the antenna and having its other end is attached to the outer conductor of the coaxial transmission line. The RC-292 antenna is further improved by the discone design of the present invention by incorporating, in the preferred embodiment, five equally spaced, equally length elongated radiating elements formed in the shape of a cone structure to thereby make up the cone portion of the discone antenna. In this embodiment, the vertical radiating element is removed.

In a further embodiment of the present invention, the RC-292 antenna design is improved by adding a disc-shaped radiating element comprised of an equal number of equally spaced elongated radiating elements to the RC-292 design and by replacing the three ground plane elements of the RC-292 with an equal number, preferably five, of equally spaced, elongated radiating elements in the form of a cone to the structure. This embodiment of the present invention thus is comprised of a vertical element, a plurality of equally spaced equal length horizontal elements in the form of a disc and a plurality of equal length equally spaced ground plane elements in the form of a cone. These elements are supported on an insulator assembly through which the coaxial cable transmission line is passed for connection to the radiating elements

OBJECTS OF THE INVENTION

Accordingly, it is the primary object of the present invention to disclose a wideband antenna having improved frequency range over prior art designs.

It is a further object of the present invention to disclose a wideband antenna that requires only 50% of the volume of other antenna designs while maintaining the same low or lower frequency cutoff point.

It is a still further object of the present invention to disclose an improved discone antenna having a novel mechanism for lowering the low frequency cutoff point of the antenna.

Other objects, advantages and novel features of the invention will become apparent from the following detailed description of the invention when considered in conjunction with the accompanying drawings.

DESCRIPTION OF THE PREFERRED EMBODIMENT

Figure 1:
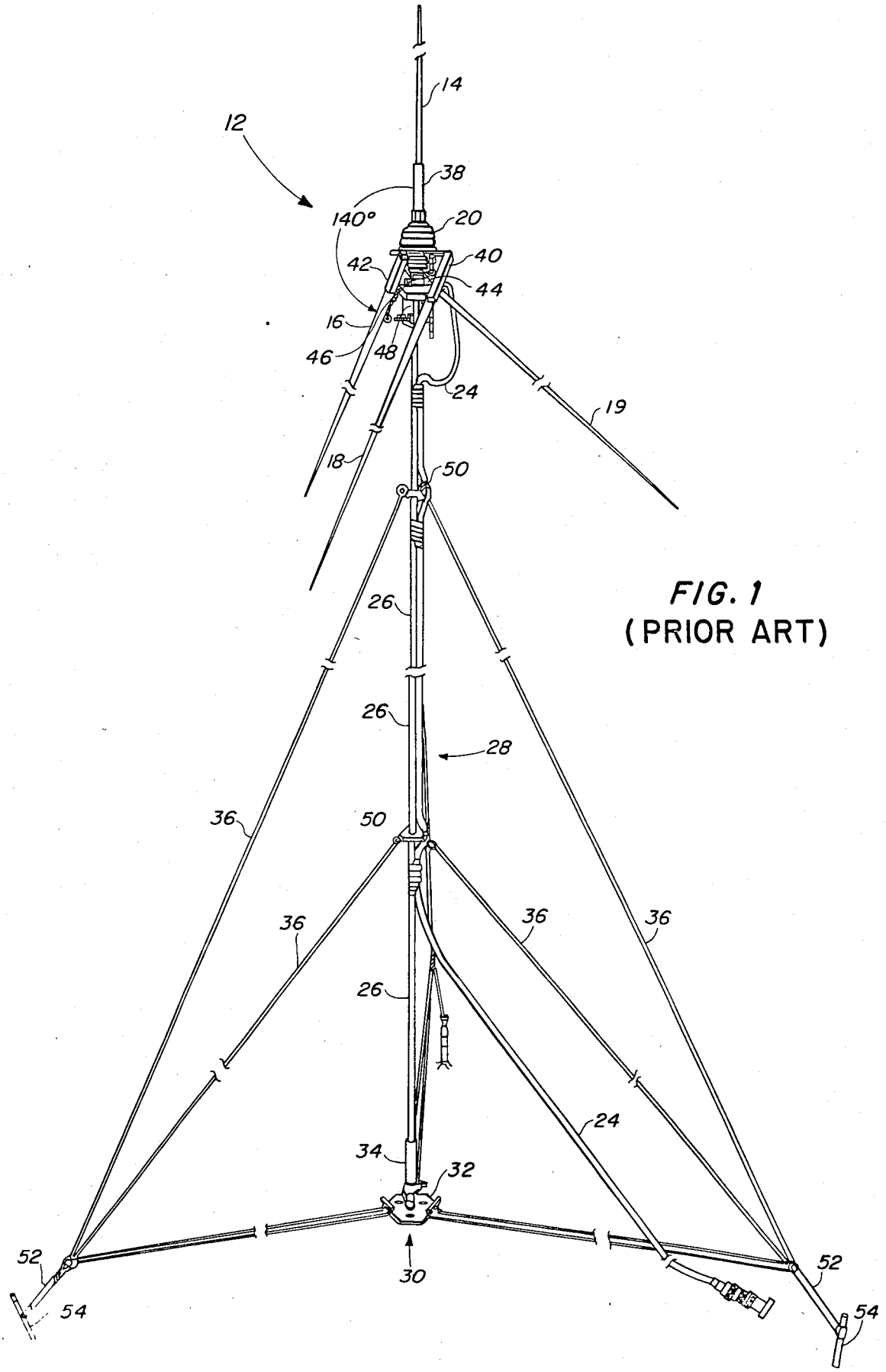
FIG. 1 (PRIOR ART)
FIG. 1 is a schematic side view of DoD's RC-292 prior art antenna.

In order to facilitate an understanding of the present invention, a prior art antenna will first be described with reference to FIG. 1. FIG. 1 illustrates a military antenna 12 known as the RC-292 antenna. The antenna 12 is an elevated, ground-plane antenna designed for radio sets operating in the 30–76 Mc range. The RC-292 antenna 12 is comprised of one vertical radiating element 14 which makes an angle of 140° with the ground-plane elements 16, 18 and 19. Antenna base 20 mounts the four antenna elements 14, 16, 18 and 19 and is used to connect the antenna to the radio set to be utilized by means of coaxial transmission line 24. Twelve mast sections 26 are joined together to form the 30 foot mast assembly 28 for elevating the antenna 12 above ground. The mast assembly 28 is supported on a mast base assembly 30 including base plate 32 and swivel ground stake 34. The mast assembly 28 is held in vertical position by guy ropes 36. The lengths of the antenna elements 14, 16, 18 and 19 are adjusted for different frequency ranges by changing the number of mast sections which make up the elements 14, 16, 18 and 19. Further, the antenna elements 14, 16, 18 and 19 are connected to antenna base 20 by means of base socket members 38, 40, 42 and 44, respectively. Swivel stake 34 facilitates lowering of the antenna to make changes in the antenna mast section lengths.

The vertical radiating element 14 and the three ground plane elements are each comprised of two to five mast sections. The mast sections are preferably copper plated, painted tubes of high-strength steel which can be screwed together.

Figure 1A:
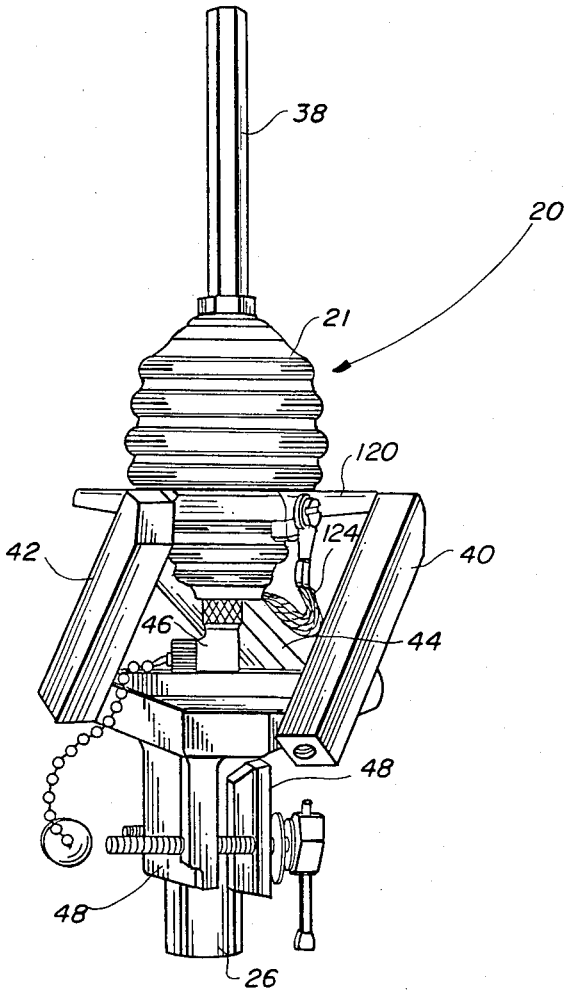
FIG. 1A (PRIOR ART)
FIG. 1A is a side view of the RC-292 base insulator assembly.

As can be seen more clearly in FIG. 1A, the antenna base 20 is comprised of a ceramic feedthrough insulator 21, sockets 38, 40, 42 and 44 for mounting the antenna elements, adaptor 46 for connecting to the coaxial transmission line 24 and a vice 48. The feedthrough insulator 21 allows the vertical radiating element socket 38 to be connected through coaxial adaptor 46 to the center conductor of the coaxial transmission line 24. The three ground plane sockets 40, 42 and 44 and the outer conductor of the coaxial transmission line 24 connect to the metal framework of the antenna base 20. The vise 48 enables the antenna base to be clamped to the top of the supporting mast assembly 28. The mast 28 may be comprised of mast sections 26 as previously mentioned and any number of sections 26 may be utilized depending on the height to which the antenna is intended to be elevated above ground. Each mast section 26 is tubular and has a male and female end which permit the sections to be fitted together.

The antenna is secured in the vertical position by means of guy ropes 36 attached to guy plates 50 and by means of guy straps 52 which are secured to ground stakes 54.

Another prior art antenna is disclosed in U.S. Pat. No. 3,618,107 wherein a broadband discone antenna is illustrated and described. The discone antenna disclosed in U.S. Pat. No. 3,618,107 differs from the present invention in that it does not utilize a vertical radiating element to reduce the low frequency cutoff point nor does it utilize a parallel inductor connected between the inner and outer conductors of the coaxial transmission line feeding the antenna to reduce the low frequency cutoff point.

Figure 2:
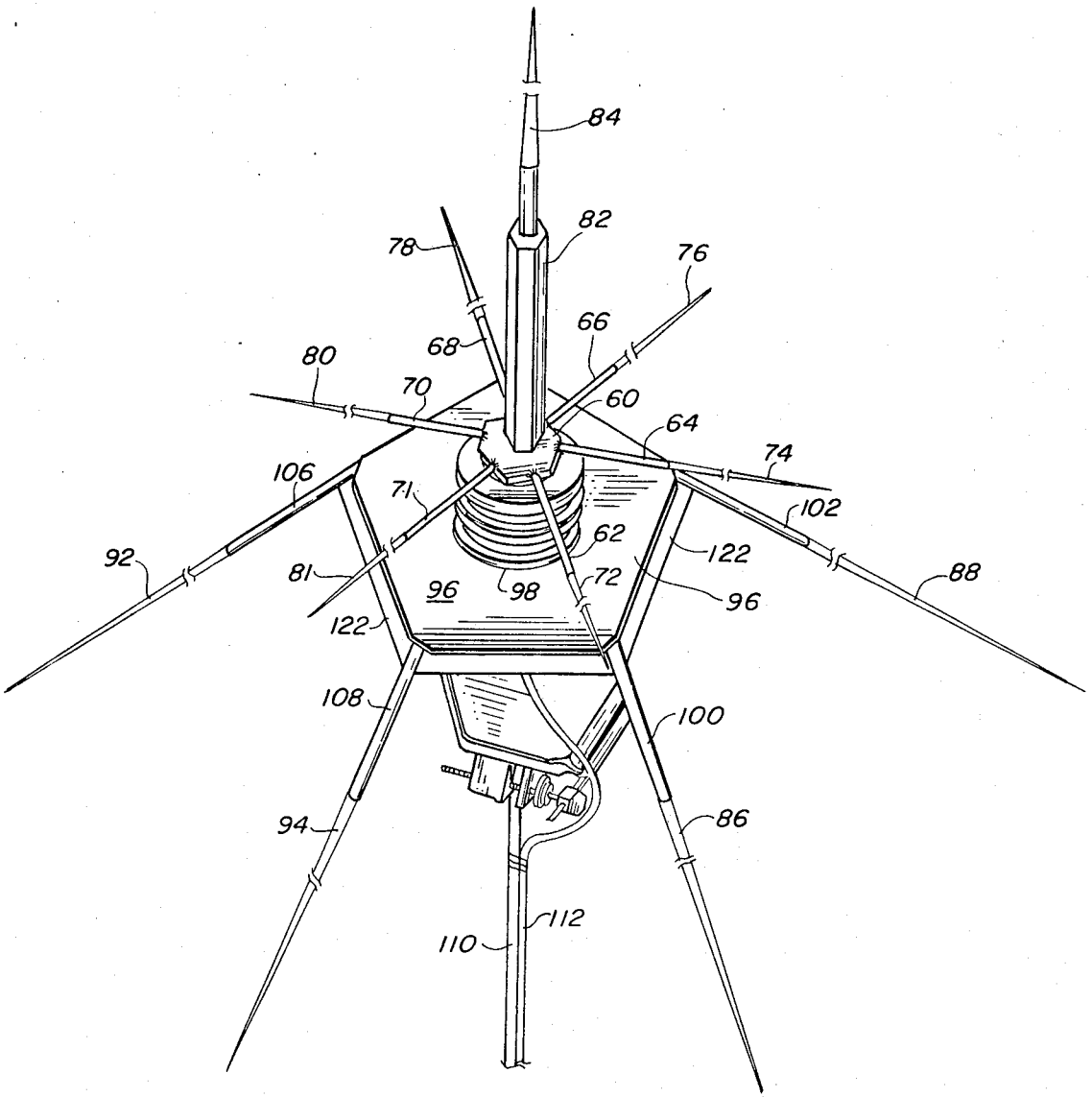
FIG. 2 is a side view of a first embodiment of the improved antenna in accordance with the present invention.

Referring now to FIG. 2, there is illustrated a side view of the verdicone antenna embodiment of the present invention. The term "verdicone" is utilized herein to connotate an antenna that is similar to a discone antenna but that utilizes a vertical radiating element. The verdicone antenna of the present invention also differs from the prior art RC-292 antenna illustrated in FIG. 1 in that it utilizes a disc type of radiating structure, to be described, along with five equally spaced ground plane elements which may be described as a cone-type radiating structure in addition to the vertical radiating element. More specifically, and referring to FIG. 2, the RC-292 antenna design is modified to inclulde a socket hub 60 that includes six radial socket members 62, 64, 66, 68, 70 and 71 to which six equally spaced horizontal radiating elements 72, 74, 76, 78, 80 and 81 are attached. The hub 60 also includes a vertical socket 82 to which the vertical radiating element 84 is secured. The radiating elements 72, 74, 76, 78, 80 and 81 may be envisioned as the disc portion of a discone radiating structure. The verdicone antenna of the present invention is further comprised of five equally spaced, equal length ground plane elements 86, 88, 90 (not shown), 92 and 94. These five ground plane elements are connected to ground plane hub member 96 that is secured to base insulator assembly 98 which is identical to the base insulator assembly 20 of the RC-292 antenna illustrated in FIG. 1. Further, five hub sockets 100, 102, 104, 106 and 108 are secured to the lower hub member 96 as by welding. The lower antenna elements that form the cone shaped antenna radiator of the present invention, namely antenna elements 86, 88, 90, 92 and 94 each have male threaded members at the upper end which engage with female threaded portions on the lower ends of socket members 100, 102, 104, 106 and 108. The details of the construction of the insulator assembly 98, the upper hub member 60 including the radial socket members 62, 64, 66, 68, 70 and 71 as well as the lower hub member 96 with its socket members 100, 102, 104, 106 and 108 are shown more clearly in detail in the partially cutaway sideview of the base insulator 98 and related assemblies illustrated in FIGS. 3, 4 and 5. The remaining portion of the embodiment of applicant's invention illustrated in FIG. 2 including the support mast 110, the coaxial transmission line 112 and the various guy wires, guy plates, guy straps and ground stakes are identical to those illustrated in the prior art illustration of the RC-292 antenna shown in FIG. 1. In the embodiment of applicant's invention illustrated in FIG. 2, the horizontal elements comprising the disc portion of the verdicone antenna, namely radiators 72, 74, 76, 78, 80 and 81 are, in the preferred embodiment of the present invention 44" long each and each of the five ground plane elements 86, 88, 90, 92 and 94 are, in the preferred embodiment of the present invention 104" long. The vertical radiating element 84 is, in the preferred embodiment, 65" long. Further, the ground plane elements 86, 88, 90, 92 and 94 each form an angle of 150° with respect to the vertical radiating element 84. Horizontal elements 72, 74, 76, 78, 80 and 81 and the vertical element 84 are mechanically and electrically connected at the antenna feedpoint and are connected to the center conductor of the coaxial transmission line 112. The feed point is at the topo end of the insulator assembly 98 illustrated in FIG. 2 and in more detail in FIG. 3. All the ground plane elements 86, 88, 90, 92 and 94 are mechanically and electrically connected at the bottom end of the insulator assembly 98 as illustrated in FIG. 2 and in more detail in FIG. 4 and are also connected to the outer conductor of the coaxial transmission line 112.

Figure 2A:
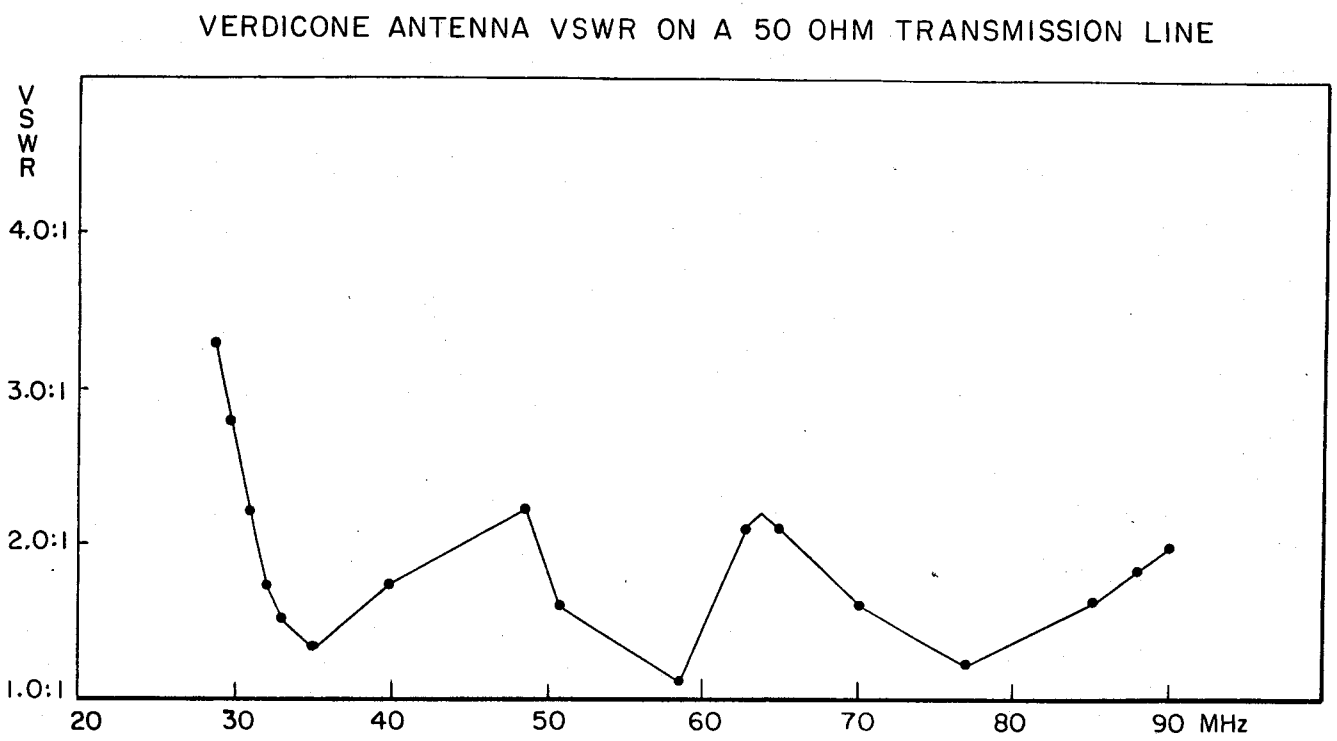
FIG. 2A is a graph of the VSWR of the antenna illustrated in FIG. 2

FIG. 2A illustrates the VSWR of the antenna configuration of FIG. 2. Changes to the vertical element 84 length will change the low frequency VSWR characteristics; as the length is made somewhat longer, the low frequency band edge is lowered in frequency and as it is made shorter, the low frequency band edge is made higher in frequency. Limits on the length of the vertical element 84 depend upon the acceptable in band VSWR. As is well known, the antenna VSWR is changed when the angle of the ground plane elements approximating the cone surface is changed. It is also well known that the number of elements used to approximate the antenna surfaces will change antenna impedance characteristics and improve VSWR as the number of elements is increased or will degrade the VSWR as the number of elements is decreased. Therefore, it is to be understood that it is within the scope of the present invention that different numbers of radiating elements from those illustrated in FIG. 2 for the horizontal elements and the ground plane radiating elements may be utilized within the scope of the present invention.

Figure 3:
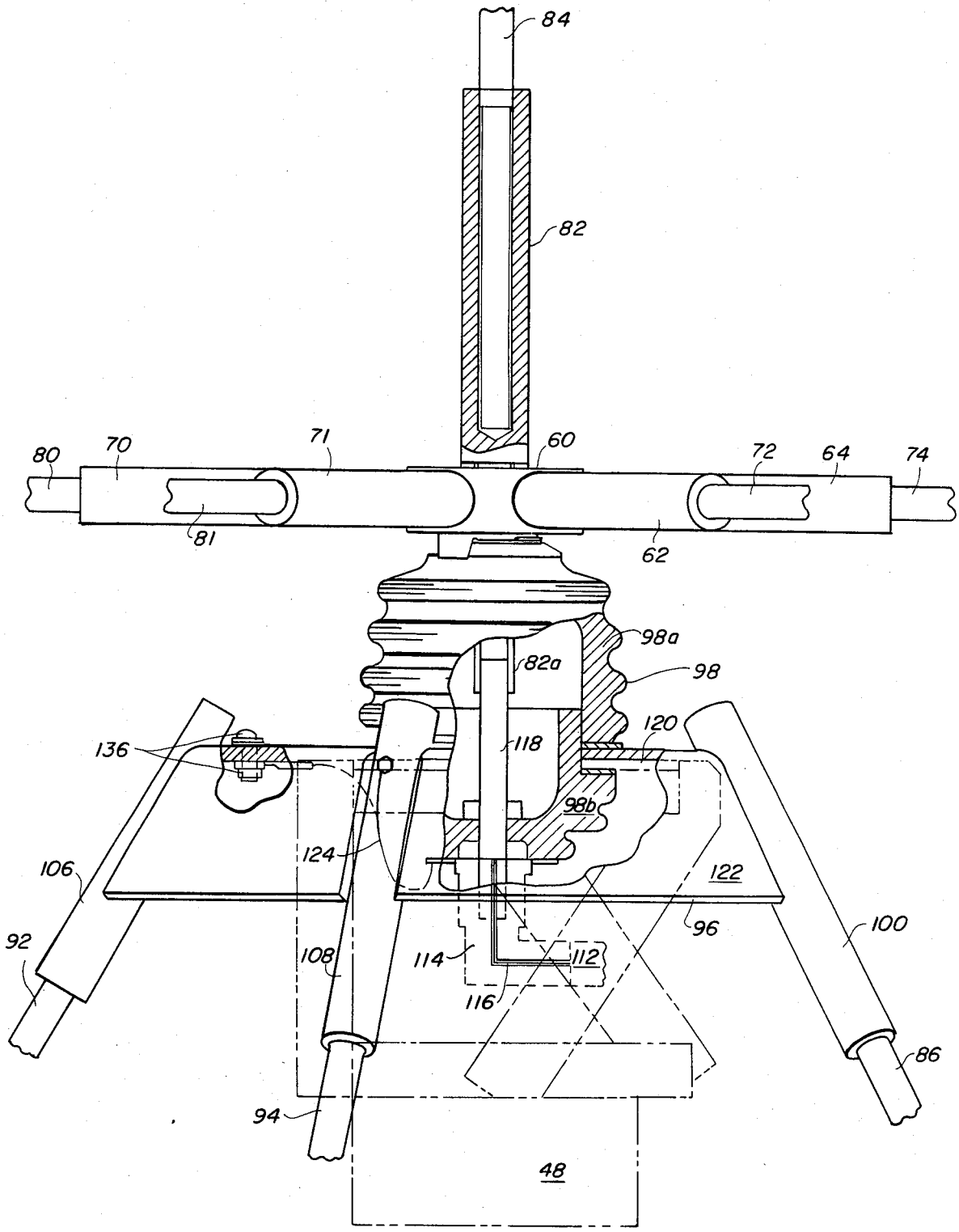
FIG. 3 is a detailed partially cutaway side view of the feed point portion of the improved antenna of the present invention.

Referring now to the partially cutaway side view of the base insulator assembly 98 illustrated in FIG. 3, the details of same will now be described. The base insulator assembly 98 is comprised of an upper portion 98*a* and a lower portion 98*b*. It can be seen that the insulator assembly 98 has a hollow interior. It can further be seen that coaxial adaptor 114 which is identical to adaptor 46 illustrated in FIG. 1, coupled to coaxial transmission line 112. It can further be seen that the insulated inner conductor 116 of transmission line 112 extends through the coaxial adapter 114. Further, upper hub 60 is attached to the top of base insulator 98 by means of threaded vertical socket member 82 that includes extension 82*a* which extends into the top portion 98*a* of the base insulator assembly 98 and couples to threaded bolt 118 which extends through the lower portion 98*b* of the base insulator assembly 98 and connects to the insulated inner conductor 116 of transmission line 112.

Further, the lower hub assembly 96 is sandwiched between the bottom surface of the upper portion 98*a* of the base insulator assembly and metallic plate 120 that forms the top plate of the metallic portion of the RC-292 antenna which includes the antenna sockets 40, 42 and 44 of the RC-292 prior art design. The lower hub member 96 includes the socket members 100, 102, 104, 106 and 108. The lower hub assembly 96 further includes mechanical strength reinforcement member 122 in the form of a skirt that extends between the socket members 100, 102, 104, 106 and 108. Electrical connection is made from the outer conductor of the coaxial transmission line 112 to the metallic member 120 by means of braided conductor 124 as can be clearly seen in the prior art FIG. 1A. Thus, the conical radiating elements comprises of elements 86, 88, 90, 92 and 94 are electrically connected to the outer conductor of the coaxial transmission line 112.

Referring again to FIG. 3, the upper hub assembly 60 including hub sockets 62, 64, 66, 68, 70 and 71 is secured in place at the feedpoint of the antenna by means of bolt extension 82*a* which extends into the base insulator upper portion 98*a* and coupled by means of male-female threaded engagement with the securing bolt 118.

Figure 4:
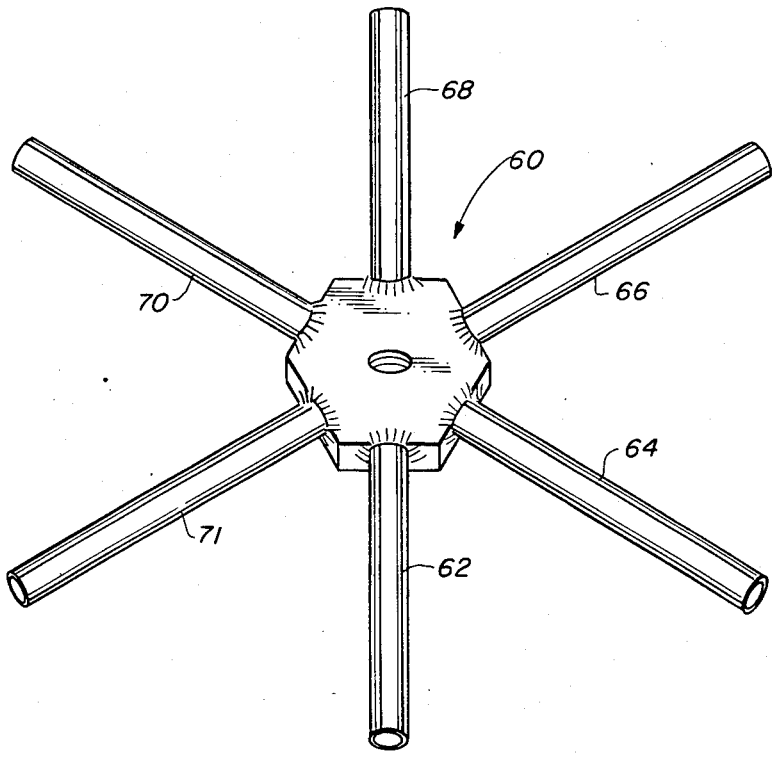
FIG. 4 is an isometric view of the upper hub portion of the present invention.
Figure 5:
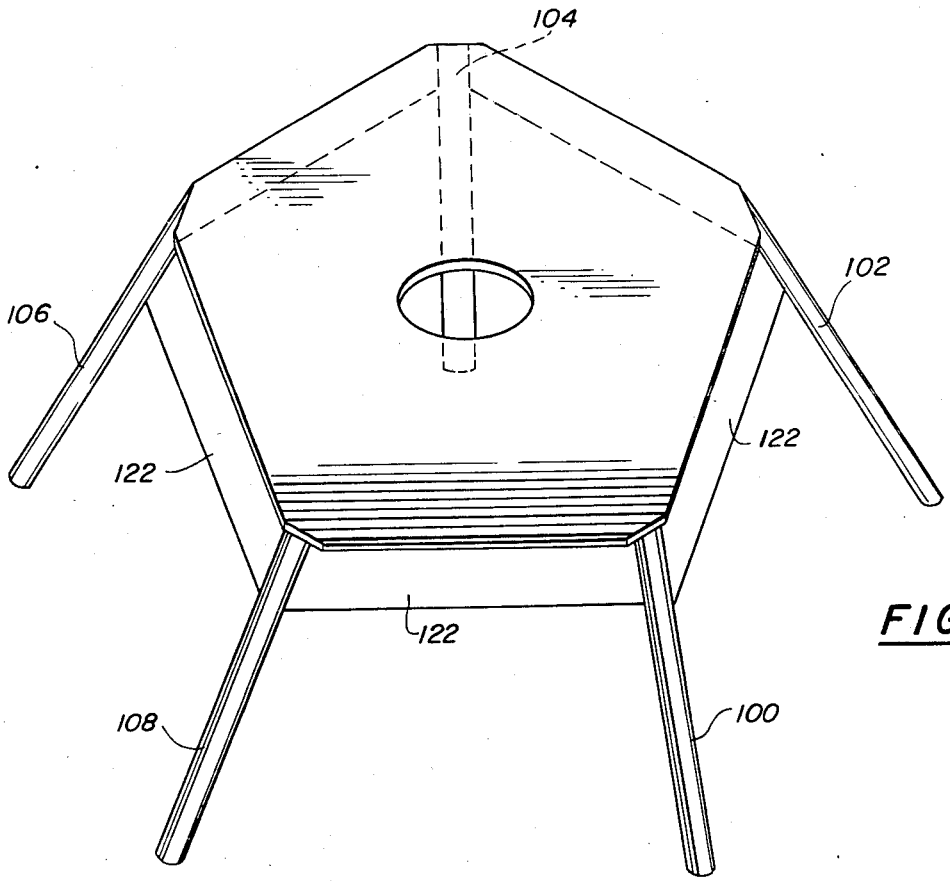
FIG. 5 is an isometric view of the lower hub portion of the present invention.

Isometric views of the lower hub 96 and the upper hub assembly 60 are shown respectively in FIGS. 4 and 5.

Figure 6:
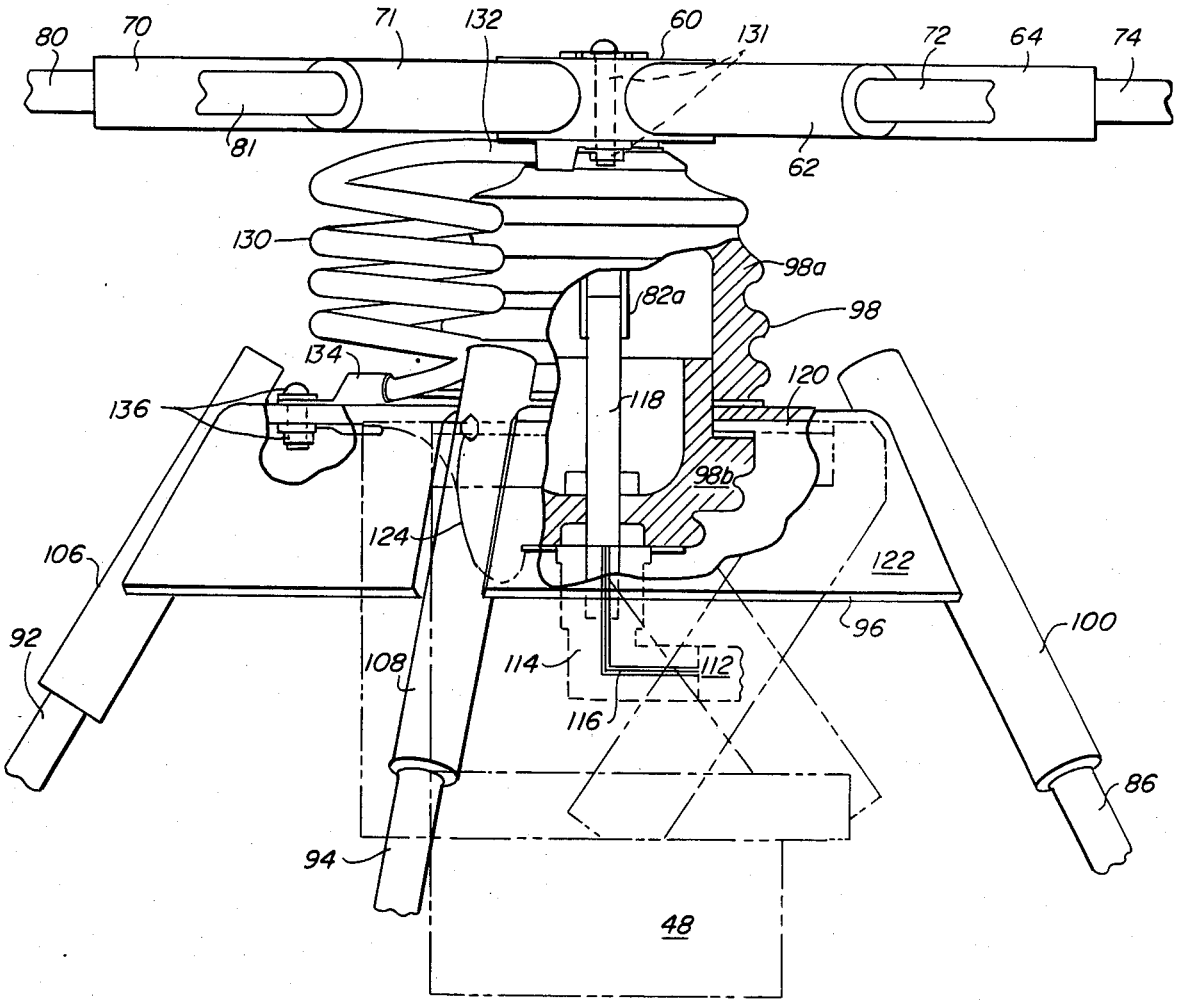
FIG. 6 is a detailed partially cut-away side view of the feed-point portion of an alternate embodiment of the improved antenna of the present invention.

In an alternate embodiment of the present invention, a second technique is utilized to lower the lower frequency cutoff point of the RC-292 antenna design. In the discone embodiment of the present invention, the vertical radiating element 84 is not utilized, i.e. it is removed from the hub socket 82. The hub socket 82, however, may be left in place. Next, referring to FIG. 6 a parallel inductor 130 is utilized to lower the lower frequency cutoff point of the antenna design. The parallel inductor 130 is electrically connected between the inner and outer conductors of the coaxial transmission line 112. The connection to the inner conductor is accomplished by connecting the upper end 132 of the parallel inductor 130 to the upper hub 60 by means of nut and bolt assembly 131 which is in turn electrically connected to the coaxial transmission line 112 inner conductor. The lower end 134 of the parallel inductor 130 is bolted by means of nut and bolt assembly 136 to the lower hub 96 top surface. It is noted at this point that in the previous embodiment wherein the vertical radiator 84 is utilized and the parallel inductor 130 is not utilized, that the ground strap 124 is mechanically and electrically connected to the lower hub member 96 using the same bolt 136 illustrated in FIG. 3. It is also noted that, referring to FIG. 1A, the socket members 40, 42 and 44 that are part of the prior art RC-292 antenna base insulator 20 are retained for structural support. It is noted further that no radiating elements are connected to these hubs 40, 42 and 44.

In order to modify existing RC-292 antennas to include the improvements of the present invention, the vertical socket member 82 is removed as is the upper portion 98*a* of the base insulator assembly 98. Next, the lower hub member 96 is fitted over the lower member 98*b* of the insulator assembly 98 and is sandwiched in place there by replacing the upper insulator assembly member 98*a*. Next, the upper hub member 60 is installed at the top end of the upper base insulator member 98*a* and the vertical socket member 82 is replaced to hold the assembly together. In the verdicone embodiment of the present invention, the parallel inductor 130 is not utilized and the ground strap 124 is connected as previously described between member 120 and the outer conductor of coaxial transmission line 112. In the alternate embodiment of the present invention, as previously described, the ground strap 124 is connected to the lower end of the parallel inductor 130 through nut, bolt assembly 136 and the upper end of the parallel inductor is connected electrically to the inner conductor of coaxial transmission line 112 via assembly 131.

Obviously many modifications and variations of the present invention are possible in the light of the above teachings. It is therefore to be understood that within the scope of the appended claims the invention may be practiced otherwise than as specifically described.

What is claimed is:

1. An antenna comprising:

a coaxial transmission line having an inner conductor and an outer conductor;

a conical antenna element having an apex, said apex being connected to said coaxial connector outer conductor;

a disc-shaped antenna element positioned adjacent said apex and electrically connected to said inner conductor; and a vertical radiating antenna element electrically connected to said inner conductor and positioned othogonally to said disc-shaped antenna element; and an antenna base comprised of an insulator, said conical antenna element, said disc-shaped antenna element and said vertical radiating element being mechanically connected to said antenna base.

2. The antenna of claim 1 wherein:

said conical antenna element comprises a first plurality of equally spaced, elongated radiating elements.

3. The antenna of claim 2 wherein said first plurality comprises five.

4. The antenna of claim 2 wherein said disc-shaped antenna element comprises a second plurality of equally spaced, elongated radiating elements.

5. The antenna of claim 4 wherein said second plurality comprises six.

6. The antenna of claim 4 wherein said vertical radiating element is approximately 65 inches long.

7. The antenna of claim 6 wherein:

each of said first plurality of equally spaced, elongated radiating elements is approximately 104 inches long.

8. The antenna of claim 7 wherein:

each of said second plurality of equally spaced, elongated radiating elements is approximately 44 inches long.

9. In an antenna including a coaxial transmission line having an inner conductor and an outer conductor, and having a base insulator and a conical antenna element having an apex and being mechanically connected to said base insulator and electrical connected to said coaxial transmission line outer conductor, and further having a disc-shaped radiating element positioned adjacent said apex and electrically connected to said coaxial transmission line inner conductor, the improvement comprising:

means for lowering the low frequency cutoff point of said antenna, connected to said coaxial transmission line inner conductor, said lowering means comprising an inductor electrically connected in parallel between said coaxial transmission line inner conductor and said coaxial transmission line outer conductor.

10. In the RC-292 antenna including a base insulator assembly and having a coaxial transmission line connected to said base insulator assembly, said base insulator assembly having a top portion and a separable bottom portion, said base insulator assembly further including a vertical antenna socket for attachment to a vertical radiating element, the improvement comprising:

a first hub member having a first plurality of hub sockets each for connecting to a horizontal radiating element, said first plurality of hub sockets being arranged radially with respect to each other and orthogonally to said vertical antenna socket, and equally spaced from each other, said first hub member being sandwiched between said base insulator top portion and said base insulator vertical antenna socket; and a second hub member having a second plurality of hub sockets equally spaced from each other, said second hub being sandwiched between said base insulator assembly top portion and said base insulator assembly bottom portion, each of said second plurality of hub sockets being for connection to one of a plurality of radiating elements.

* * * * *